US011564502B2

(12) United States Patent
Bergamaschi

(10) Patent No.: US 11,564,502 B2
(45) Date of Patent: Jan. 31, 2023

(54) SOFA-BED AND SIMILAR

(71) Applicant: RENATO NISI S.R.L., Forli' (IT)

(72) Inventor: Fausto Bergamaschi, Forli' (IT)

(73) Assignee: RENATO NISI S.R.L., Forli (IT)

( * ) Notice: Subject to any disclaimer, the term of this patent is extended or adjusted under 35 U.S.C. 154(b) by 0 days.

(21) Appl. No.: 16/876,633

(22) Filed: May 18, 2020

(65) Prior Publication Data

US 2020/0359802 A1 Nov. 19, 2020

(30) Foreign Application Priority Data

May 17, 2019 (IT) ..... 102019000006979

(51) Int. Cl.
*A47C 17/13* (2006.01)
*A47C 17/22* (2006.01)
*A47C 17/86* (2006.01)

(52) U.S. Cl.
CPC ..... *A47C 17/22* (2013.01); *A47C 17/86* (2013.01)

(58) Field of Classification Search
None
See application file for complete search history.

(56) References Cited

U.S. PATENT DOCUMENTS 1,842,248 A * 1/1932 Coopersmith ..... A47C 17/22 5/22
1,858,543 A * 5/1932 Duvall ..... A47C 17/225 5/31
2,582,904 A * 1/1952 Harman ..... A47C 17/225 5/29
2,770,814 A * 11/1956 Schindler ..... A47C 17/225 5/13
2,975,433 A * 3/1961 Coopersmith ..... A47C 17/225 5/55.1
3,030,637 A * 4/1962 Katz ..... A47C 17/225 5/13
3,239,852 A * 3/1966 Barabas ..... A47C 17/225 5/13

(Continued)

FOREIGN PATENT DOCUMENTS

| | | |
|---|---|---|
| BR | 7002295 U | 6/1991 |
| DE | 3721357 A1 | 2/1988 |
| EP | 0628269 A1 | 12/1994 |

OTHER PUBLICATIONS

IT Search Report dated Nov. 20, 2019 re: Application No. 102019000006979, pp. 1-10, citing: US 2016/0213156 A1, EP 0 628 269 A1, BR 7 002 295 U, US 3 640 545 A and DE 37 21 357 A1.

*Primary Examiner* — David R Hare
*Assistant Examiner* — Ifeolu A Adeboyejo
(74) *Attorney, Agent, or Firm* — Cantor Colburn LLP

(57) ABSTRACT

A sofa-bed includes a fixed frame and a foldable frame connected to the fixed frame and movable between an open configuration defining a bed configuration of the sofa-bed and a closed configuration defining a sofa configuration of the sofa-bed. The foldable frame includes levers hinged to the fixed frame.
The sofa-bed includes at least a pair of tie rods made of elastomeric material, wherein each tie rod extends along a substantially longitudinal direction. A first end of each one of the tie rods is connected to fixed frame and a second end of each of the tie rods opposed with respect to the first end is associated to at least one of the levers.

11 Claims, 4 Drawing Sheets

(56) References Cited

U.S. PATENT DOCUMENTS

| | | | | | |
|---|---|---|---|---|---|
| 3,281,871 | A | * | 11/1966 | Katz | A47C 17/23 5/13 |
| 3,345,651 | A | * | 10/1967 | Fox | A47C 17/23 5/13 |
| 3,508,283 | A | * | 4/1970 | Dukellis | A47C 17/225 5/13 |
| 3,640,545 | A | * | 2/1972 | Citroen | B60G 11/22 280/62 |
| 3,934,281 | A | * | 1/1976 | Brindisi | A47C 17/23 5/13 |
| 6,439,586 | B1 | * | 8/2002 | Eckelberry | B60G 11/62 280/124.164 |
| 2016/0213156 | A1 | | 7/2016 | Angle et al. | |

* cited by examiner

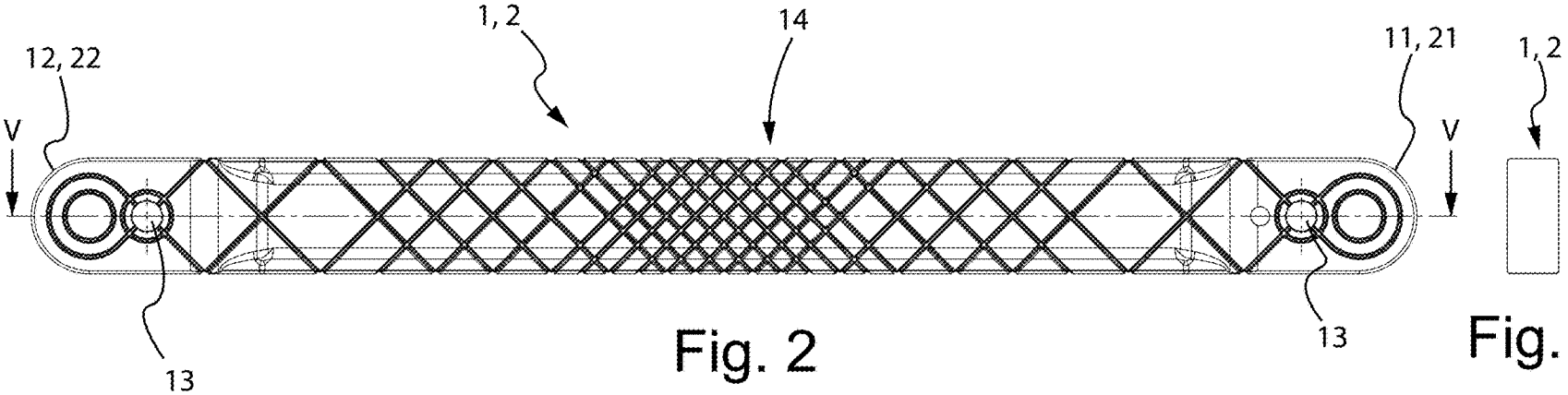
Fig. 2
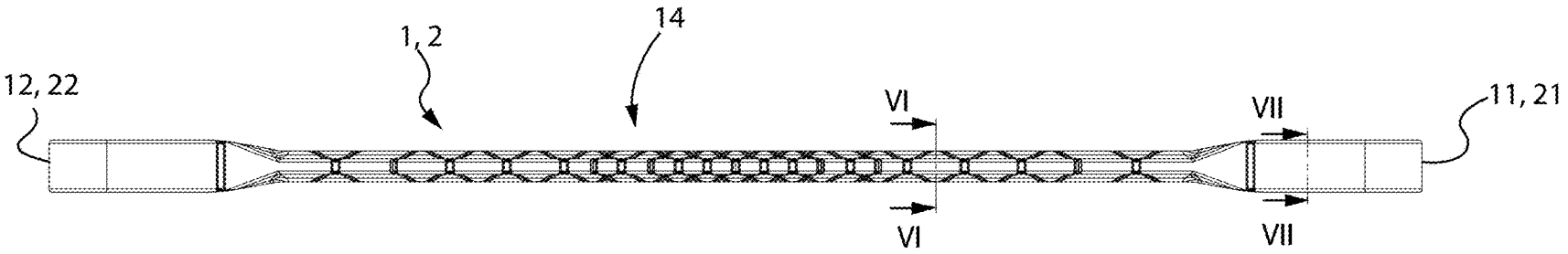
Fig. 3
Fig. 4

SOFA-BED AND SIMILAR

CROSS-REFERENCE TO RELATED APPLICATIONS

This application is related to, and claims the benefit of, Italian patent application No. 102019000006979, filed on May 17, 2019, the contents of which are hereby incorporated by reference in their entirety.

TECHNICAL FIELD

The present disclosure refers to a sofa-bed, but also to an armchair-bed, a pouf-bed or similar.

BACKGROUND

As is known, sofa-beds comprise a fixed frame and a foldable frame which can be extracted with respect to the fixed frame to switch from a sofa configuration to a bed configuration of the sofa-bed. The rigid structures of the sofa-bed, such as armrests, backrests and cover panels, can be mounted on the fixed frame. Then the sofa-bed is complemented by the seat and backrest cushions, which can be completely removable or associated with the foldable frame, and therefore move therewith.

The foldable frame is defined by a system of levers that are hinged at least to the fixed frame, but generally also to each other and/or to other structural elements of the foldable frame.

As is known, the various levers provided in a sofa-bed are generally connected to the fixed frame by metal spiral springs, which work in pairs in opposite pulling directions so as to allow that the foldable frame in both the open and closed configuration assumes mechanically stable and balanced configurations, and also to allow that the forces necessary for the user to open or close the sofa-bed be not excessive during the opening and closing steps. In other words, in a pair of opposing springs, if in the closed configuration of the sofa-bed one spring is in tension and the other is at rest, the conditions of the two springs will be reversed in the open configuration. In the transitional opening/closing steps of the sofa-bed, a spring counteracts the traction action of the other one to facilitate the operations for the user.

During these transitional steps the opposing springs also partially allow to compensate for the weight force of the sofa-bed components that the user must be able to move.

However, the sofa-beds of the known type are not free from drawbacks due to the use of metal spiral springs, among which are, for example:

- the fact that the metal springs require significant forces in the initial opening or closing step of the sofa-bed from the user and that in the final closing or opening step they tend to let the sofa-bed components being moved drop as a dead load;
- the fact that the metal springs often show abrupt behaviours during the lengthening and shortening of the same, which makes the operation of opening and closing the sofa-bed uncomfortable for the user;
- the fact that the springs tend to generate strong sudden metallic noises and squeaks during their use;
- the fact that over time, the springs tend to deform plastically or otherwise change the mechanical performance;

- the production costs and the difficulties of replacing the springs inside the sofa-bed.

SUMMARY

The aim of the present disclosure provides a sofa-bed which solves the above-mentioned technical problem, obviates the drawbacks and overcomes the limits of the prior art described above.

Within this aim, the present disclosure provides a sofa-bed whose opening and closing operations can be performed by the user with extreme ease and fluidity of movement.

The disclosure provides a sofa-bed which reduces the force required from the user to open and close the sofa-bed itself, without this having negative consequences on the mechanical stability of the opening and closing configurations of the sofa-bed.

The disclosure further provides a sofa-bed which does not produce unpleasant metallic noises.

The disclosure also provides a sofa-bed which is capable of giving the widest guarantees of reliability and safety in use.

The disclosure also provides a sofa-bed which is easy to manufacture and economically competitive when compared to the prior art.

The task disclosed above, and also the advantages mentioned and others which are more apparent below, are achieved by a sofa-bed as described in claim 1.

Other features are provided in the dependent claims.

BRIEF DESCRIPTION OF THE DRAWINGS

Further features and advantages shall be more apparent from the description of a preferred, but not exclusive, embodiment of a sofa-bed, illustrated merely by way of non-limiting example with the aid of the accompanying drawings, in which:

FIG. 2 is a front elevation view of the tie rod of FIG. 1, according to the disclosure;

FIG. 3 is a side elevation view of the tie rod of FIG. 1, according to the disclosure;

FIG. 4 is a top plan view of the tie rod of FIG. 1, according to the disclosure;

DETAILED DESCRIPTION OF THE DRAWINGS

Figure 9:
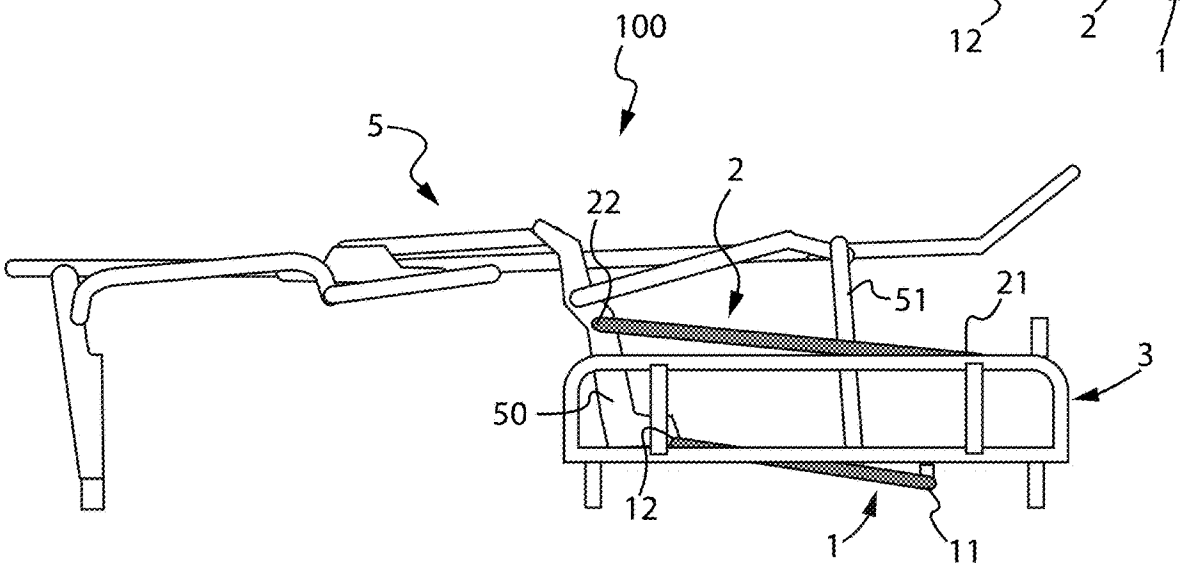
Figure 8:
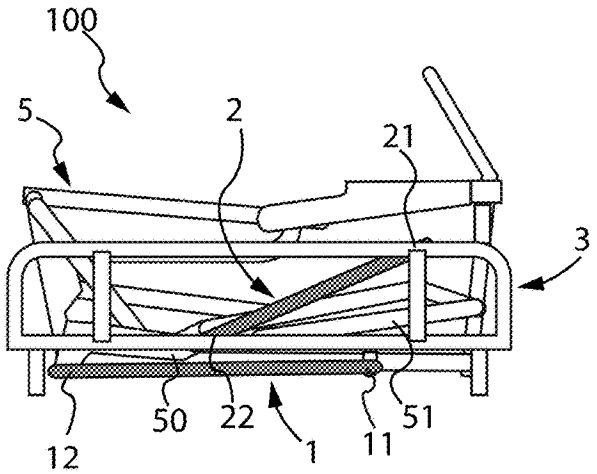

With reference to the aforementioned figures, the sofa-bed, indicated globally by the reference number 100, comprises a fixed frame 3 and a foldable frame 5 associated to said fixed frame 3 and movable between an open configuration, illustrated in FIG. 9, defining a bed configuration of the sofa-bed 100 and a closed configuration, illustrated in FIG. 8, defining a sofa configuration of the sofa-bed 100. The foldable frame 5 comprising a plurality of levers 50, 51 hinged to the fixed frame 3.

According to the disclosure, the sofa-bed 100 comprises at least a pair of tie rods 1, 2 made of elastomeric material, wherein each one of said tie rods 1, 2 extends along a substantially longitudinal direction, and wherein a first end 11, 21 of each tie rod 1, 2 is associated to the fixed frame 3 and wherein a second end 12, 22 of each tie rod 1, 2 opposed with respect to the first end 11, 21 is associated to at least a lever 50 of said plurality of levers 50, 51.

Advantageously, the sofa-bed 100 comprises at least two pairs of said tie rods 1, 2 respectively associated with the fixed frame 3 and said at least one lever 50 of the plurality of levers 50, 51, on opposite sides of the sofa-bed 100. These two pairs of tie rods 1, 2 have a symmetrical arrangement and behaviour between them.

Advantageously, each tie rod 1, 2 has at its ends 11, 21, 12, 22 a hole 13 for fixing to a corresponding pin or hook provided on the fixed frame 3 and/or on said at least one lever 50.

The hole 13 is preferably a through hole.

Advantageously, as illustrated in the accompanying figures, each one of the tie rods 1, 2 has a length of an order of magnitude greater than its height and/or greater than its thickness.

Advantageously, each tie rod 1, 2 has a length ranging between 360 and 510 millimeters, preferably between 400 and 470 millimeters, and more preferably substantially equal to 435 millimeters.

Advantageously, each tie rod 1, 2 has a height ranging between 60 and 10 millimeters, preferably between 45 and 25 millimeters, and more preferably substantially equal to 35 millimeters.

Advantageously each tie rod 1, 2 has, in its central portion 14 with respect to the two ends 11, 21, 12, 22, a transverse thickness ranging between 15 and 5 millimeters, preferably between 12 and 8 millimeters, and more preferably substantially equal to 10 millimeters.

In a variant of the tie rod 1, 2 not illustrated in the accompanying figures, the tie rod 1, 2 can have slightly smaller dimensions in terms of length, which can range between 300 and 360 millimeters, and preferably between 320 and 340 millimeters.

Figure 6:
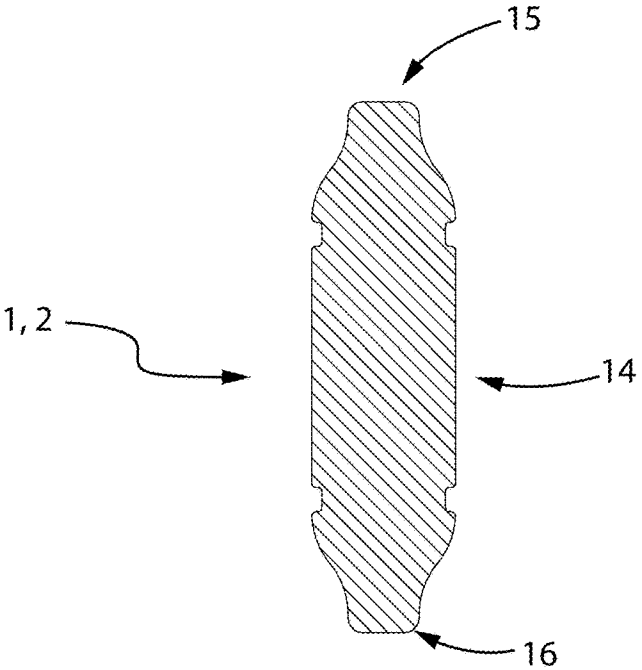
FIG. 6 is a sectional view of the tie rod represented in FIG. 4, performed according to the axis VI-VI.

FIG. 6 illustrates a cross section of the tie rod 1, 2 at the aforesaid central portion 14, which has a thickness of about 10 millimeters and a height of about 35 millimeters.

Advantageously, as illustrated in the accompanying figures and in particular in FIG. 6, the thickness of the tie rod 1, 2 tapers slightly at the ends of the upper and lower sides 15 and 16.

Figure 1:
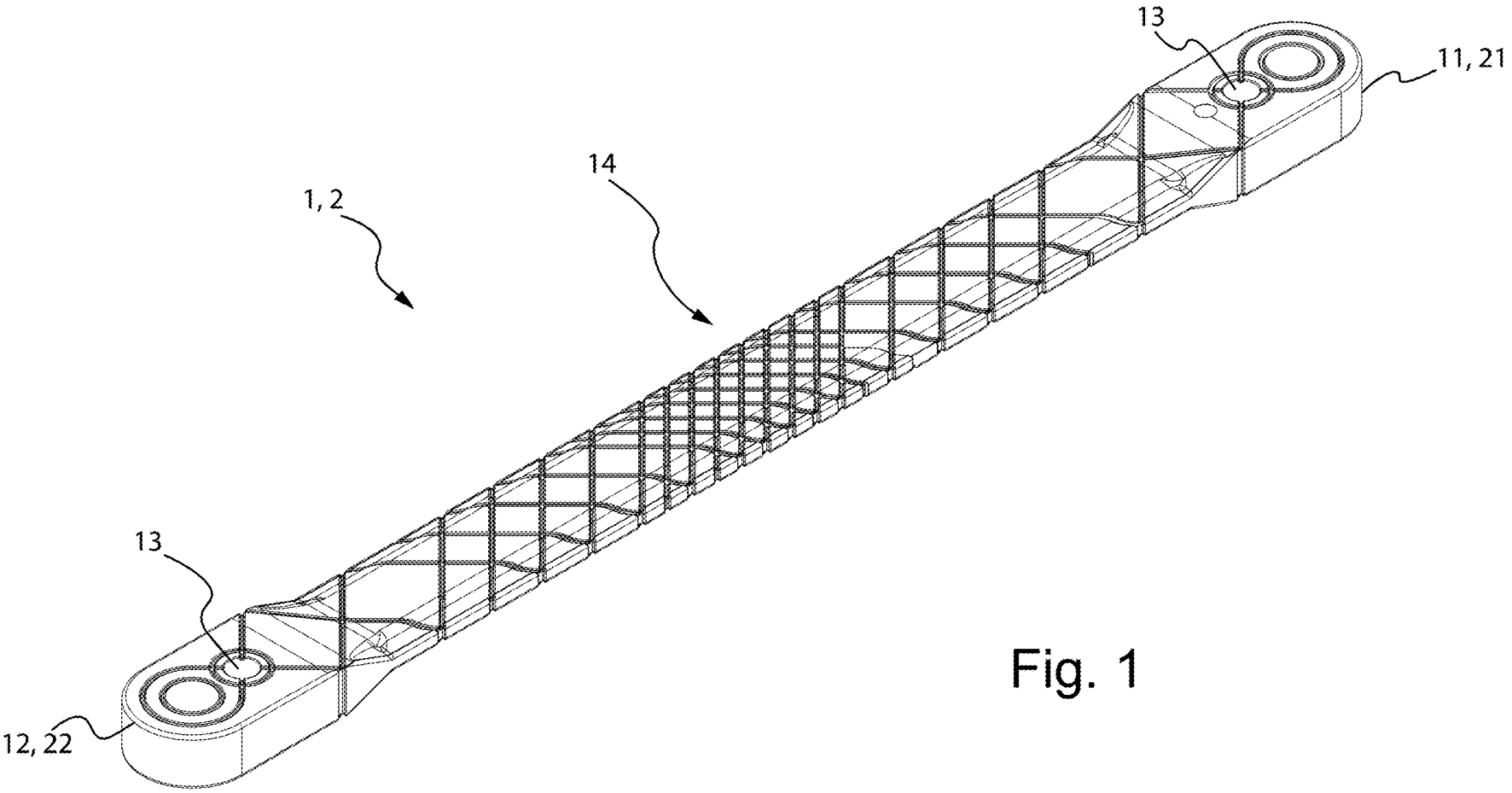
FIG. 1 is a perspective view of a tie rod of an embodiment of a sofa-bed, according to the disclosure.
Figure 5:
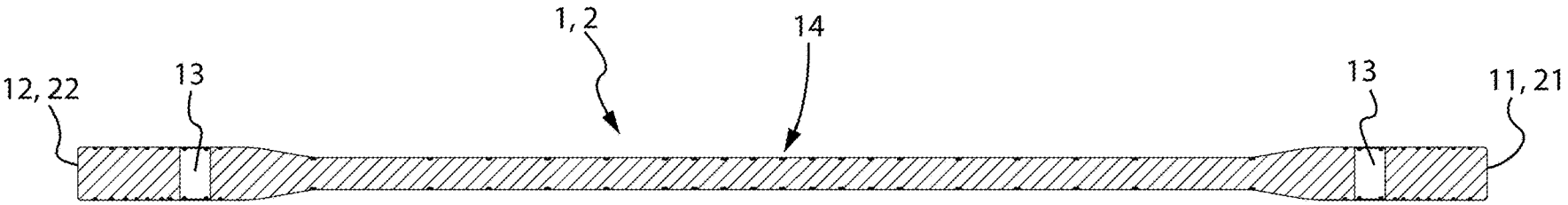
FIG. 5 is a sectional view of the tie rod represented in FIG. 2, performed according to the axis V-V.
Figure 7:
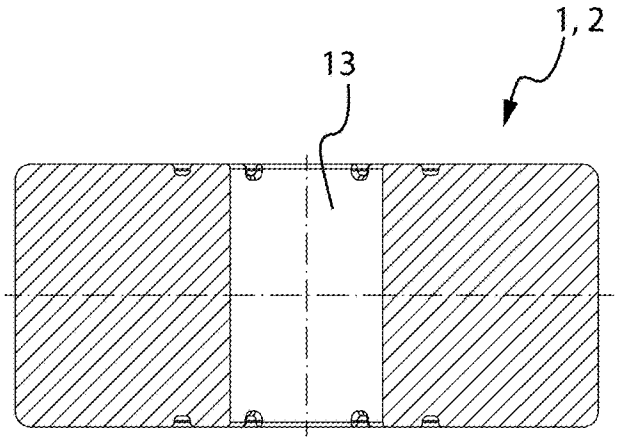
FIG. 7 is a sectional view of the tie rod represented in FIG. 4, performed according to the axis VII-VII.

Advantageously, as illustrated in the accompanying figures, and in particular in FIG. 7, the ends 11, 12, 21, 22 of each tie rod 1, 2 are reinforced.

Advantageously, these ends have indeed a transverse thickness ranging between 20 and 10 millimeters, preferably between 17 and 13 millimeters, and more preferably substantially equal to 15 millimeters.

Advantageously therefore, also the through hole 13 has a length ranging between 20 and 10 millimeters, preferably between 17 and 13 millimeters, and more preferably substantially equal to 15 millimeters. This length is such as to prevent any inclinations of the tie rod 1, 2 around the pin or hook provided in the fixed frame 3 and/or in the lever 50, with respect to a central longitudinal axis.

In other words, this length of the through hole 13 prevents the tie rod 1, 2 from inclining excessively sideways.

Advantageously, the distance between the two holes 13, of the same tie rod 1, 2, has a length ranging between 420 and 310 millimeters, preferably between 390 and 340 millimeters, and more preferably substantially equal to 365 millimeters.

Advantageously, the distance between the central axis of each hole 13 and the most distal portion of the relative end 11, 12, 21, 22 of each tie rod 1, 2 ranges between 60 and 10 millimeters, preferably between 45 and 25 millimeters, and more preferably substantially equal to 35 millimeters.

Taking into account that the traction forces to which the tie rods 1, 2 are subjected are mainly unloaded at the holes 13 in a peripheral direction, the fact that the ends 11, 12, 21, 22 of the tie rods 1, 2 have both a thickening of the thickness and a significant mass of elastomeric material at the peripheral areas of the tie rods 1, 2 near the holes 13 contributes to a greater resistance of the tie rods 1, 2, precisely at the areas subject to higher traction loads.

Advantageously, the elastomeric material of which the tie rods 1, 2 are made is a synthetic or natural elastomeric material.

Preferably the elastomeric material of which the tie rods 1, 2 are made is polyisoprene, and more preferably cis-polyisoprene.

Advantageously, the elastomeric material of which the tie rods 1, 2 are made has a Shore A hardness ranging between 30 and 95.

Advantageously, the elastomeric material of which the tie rods 1, 2 are made has a density ranging between 0.96 and 1.55 g/cm$^3$.

Furthermore, as illustrated in FIGS. 1 to 7, the tie rod 1, 2 is constituted by a single solid body with an elongated shape, made of said elastomeric material and having the aforesaid holes 13 at the ends.

The elastomeric material of which the tie rods 1, 2 are made has excellent mechanical properties in terms of breaking strength, elongation and tear strength, even without the use of reinforcing fillers. Furthermore, this material has excellent abrasion resistance and an excellent elastic yield.

Advantageously, the holes 13 at the ends of the tie rod 1, 2 can comprise an internal reinforcement coating made of nylon, preferably of nylon with 30% glass charge, in the form of a bush.

Advantageously, for each end of the tie rod 1, 2, two or three holes can be provided for coupling to the rigid structures of the sofa-bed 100, mutually spaced along the longitudinal direction of extension of the tie rod 1, 2. In this way it is possible to couple the tie rod 1, 2 to the pins or hooks provided in the rigid structures of the sofa-bed 100 at the different holes of the tie rod 1, 2 itself, depending on the distance between these pins or hooks and/or as a function of the traction force that is wished for the tie rod 1, 2 to be exerted between the aforesaid rigid structures.

Advantageously, the tie rod 1, 2 can comprise, at each end, a rigid core embedded inside the elastomeric material of which the tie rod 1, 2 is made. Advantageously, the hole 13 provided at each end of the tie rod 1, 2 can have an internal coating in the form of a bush which is made as a single piece with such a rigid core.

Advantageously, even if a plurality of holes are provided at each end of the tie rod 1, 2, these holes can comprise an internal coating in the form of a bush made as a single piece with a rigid core. In this way the mutual distance between the holes of each end is kept substantially constant during the use of the tie rod 1, 2.

Advantageously, said rigid core can be made of nylon, preferably of nylon with 30% glass charge. Advantageously, this rigid core can be inserted in the tie rod 1,2 through co-molding techniques.

The present disclosure also relates to a tie rod 1, 2 for a sofa-bed 100, as described above.

The operation of the sofa-bed 100 provided with tie rods 1, 2 is clear and evident from what has been described.

In particular, the tie rods 1, 2 can be used instead of the metal spiral springs in any type of sofa-bed, improving the opening mechanism of the sofa-bed itself.

Figure 10:
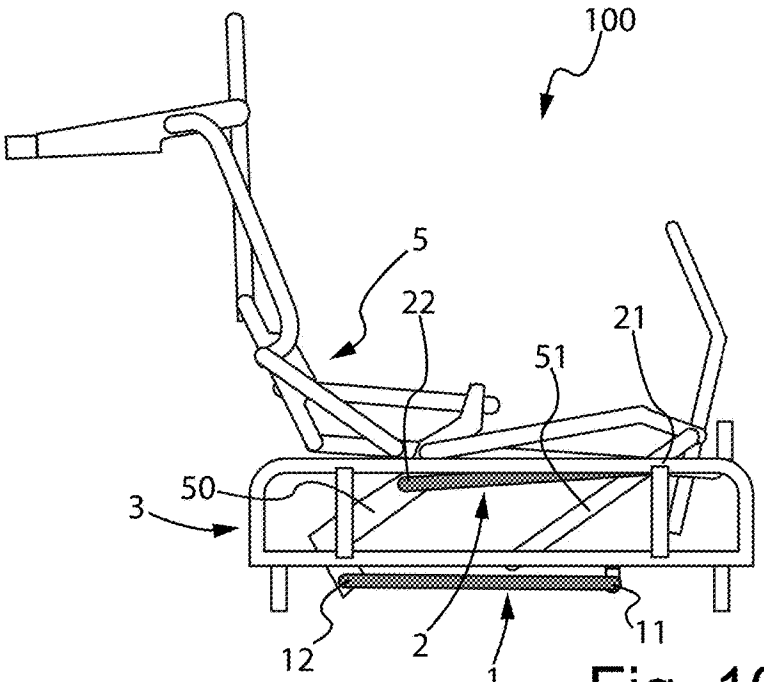
FIGS. 8, 9 and 10 are lateral schematic views of the structure of an embodiment of the sofa-bed, according to the disclosure, illustrated respectively in a closed, open configuration and in an intermediate configuration between the open configuration and the closed configuration.

FIGS. 8, 9 and 10 schematically illustrate the behaviour of the sofa-bed 100, and therefore of the tie rods 1, 2, in the passage from a closed configuration to an open configuration of the same.

In particular, in the closed configuration of the sofa-bed, illustrated in FIG. 8, with the foldable frame 5 folded on itself, the pairs of lateral tie rods 1, 2, which allow the foldable frame 5 to be opened (and then closed), have a tie rod 1 in tension and another tie rod 2 at rest, not subjected to stresses, respectively.

As the sofa-bed 100 is opened by the user, by raising the plane of the sofa-bed 100 and, through a play of planes connected between them, each pair of tie rods 1, 2 changes its state by reacting to the stresses of the levers 50 of the foldable frame 5.

For each pair of tie rods 1, 2 the tie rod 1, which in the accompanying figures is the lower one, loses the traction stress, getting shorter until it reaches the unloaded state, thus making the levers 50 which are connected thereto impart a thrust upwards to the planes of the sofa-bed 100 helping the user in their deployment and requiring from him less force to open and deploy the planes of the sofa-bed 100.

However, the action of the tie rod 2, which in the accompanying figures is the upper one, is there and counteracts this thrust, which tie rod at the same time switches from the state without loads to a traction stress that causes its lengthening as the sofa-bed 100 is opened. The actions of the two tie rods 1, 2 counteract and allow the user a gradual and soft operation in the opening of the sofa-bed 100, with the lower tie rods 1 pushing and the upper tie rods 2 braking the unwinding of the planes of the sofa-bed 100.

As the total deployment process of the planes of the sofa-bed 100, as far as the open configuration of FIG. 9, with all the planes extended in succession horizontally, is near the end, the lower tie rods 1 will be totally shortened, completing the loss of traction preloaded initially until the rest/unloaded state is reached. At the same time the two upper tie rods 2 are stressed by a greater traction the more the sofa-bed 100 is opened, because the greater the deployment of the planes, through the levers connected between them, the greater the traction effort of the upper tie rods 2.

The thrust due to the less traction of the lower tie rods 1 gradually becomes weaker simultaneously with the greater traction to which the upper tie rods 2 are subjected, braking the deployment of the planes of the sofa-bed 100.

The control between the less upward thrust, in this step, caused by the lower tie rods 1 and the greater resistance in braking the lying surface of the bed plane, caused by the upper tie rods 2, results in a softer, gradual and less abrupt movement until the total deployment of the planes of the sofa-bed 100.

With the sofa-bed 100 totally open in the bed configuration, therefore with all the horizontal planes in succession, the foldable frame 5 will have the levers positioned in such a way that the lower tie rods 1 will have reached the rest state, i.e. totally unloaded from stresses, while, at the same time, the upper tie rods 2 are in the state of maximum traction stress.

The process in reverse occurs for the operations leading from the totally open bed to the sofa configuration (i.e. with the foldable frame 5 closed).

Advantageously, therefore, with specific reference to the embodiment of the disclosure whose operation is described above, the tie rods 1, 2 of a pair of tie rods are able to simultaneously perform two opposing actions to control the forces involved in the passage from the open configuration to the closed configuration of the sofa-bed 100, and vice versa.

It has been practically noted that the sofa-bed, according to the present disclosure, fulfils the task and the predefined advantages as it has elastomeric tie rods which replace the metal spiral springs and therefore overcome all the associated drawbacks.

An advantage of the sofa-bed according to the disclosure is that no matter how long the tie rods provided in it can remain in tension, they will not lose the property of immediately returning to the original shape, i.e. without marked hysteresis phenomena, where hysteresis means the slowness in recovering the memory of one's original form which, on the other hand, must be restored almost immediately. i.e. in the period of time in which the opening/closing action performed by the user takes place.

In essence, the tie rods of the sofa-bed according to the disclosure are able to exert great forces, with accentuated elasticity, with no hysteresis and with resistance to preload even for prolonged periods of time.

In fact, it is necessary to take into account that a sofa-bed can remain closed, therefore in the sofa configuration, for days, weeks or months. And the same applies in the bed configuration, therefore with its planes in succession totally extended.

All the aforementioned characteristics of elasticity, no hysteresis and resistance over time to the pre-load condition are maintained by the elastomeric tie rods of the sofa-bed according to the disclosure for thousands of opening/closing cycles of the foldable frame and for several years of use, without appreciable deviations from the expected performances. This allows to significantly reduce the service interventions for the replacement of the tie rods, with respect to what occurs in the case of traditional metal springs, with consequent reductions in overall costs.

Moreover, with respect to traditional metal spiral springs, the curve of the movement of the tie rods of the sofa-bed according to the disclosure is much softer, it does not have sudden jumps during the opening or closing of the foldable frame, but it follows the movement of the sofa-bed structure whose weight is a few tens of kg, so as to easily allow the opening and closing operations even by users of any age or physical condition.

Other important advantages of the sofa-bed according to the disclosure, with respect to the sofa-beds in which the spiral metal springs are fitted, is featured by a greater noiselessness, both of the tie rod itself and of the connecting elements (hook or pin) of the rigid structures to the tie rod, as well as the greater lightness and the smaller overall volume.

Furthermore, another important advantage is linked to the possibility of realising the aforesaid tie rods through molding techniques, and therefore the consequent possibility of making customizations, both in terms of length, pre-load, design and colour, with the consequent possibility that the tie rods can also be left visible in the sofa-bed.

Another advantage of the sofa-bed, according to the disclosure, is the use of elastomeric tie rods makes the sofa-bed itself safer. Furthermore, the elastomeric tie rods are also more easily replaceable than the metal spiral springs.

The tie rods provided in the sofa-bed according to the disclosure furthermore have a constant ratio between the lengthening of the same tie rod and the time required for this lengthening, which results in a constant and repeatable greater fluidity of the elastic behaviour. In other words, thanks to the presence of the elastomeric tie rods, the opening or closing of the sofa-bed does not require, in the initial step, excessive efforts to start the movement. At the same time, once the movable elements of the sofa-bed have "overcome the top", thanks to the presence of the elastomeric tie rods, these movable elements do not tend to drop owing to their own weight, but instead are continuously supported by the elastomeric tie rods even in the final step of their movement.

The sofa-bed as it is conceived is susceptible to numerous modifications and variants, all falling within the scope of the inventive concept.

Furthermore, all the details can be replaced by other technically equivalent elements.

In practice, any components and materials can be used according to requirements, as long as they are compatible with the specific use, the dimensions, the contingent shapes and the prior art.

The invention claimed is:

1. A sofa-bed comprising:

a fixed frame, and a foldable frame attached to said fixed frame and movable between an open configuration defining a bed configuration of said sofa-bed and a closed configuration defining a sofa configuration of said sofa-bed, said foldable frame comprising a plurality of levers hinged to said fixed frame, and at least a pair of tie rods made of elastomeric material, each one of said tie rods extending along a substantially longitudinal direction, wherein a first end of each one of said tie rods is attached to said fixed frame and wherein a second end of each one of said tie rods opposed with respect to said first end is attached to at least a lever of said plurality of levers, wherein each one of said tie rods has a central portion with a thickness that tapers slightly at the ends of upper and lower sides of said tie rods, wherein each end of said tie rod has a thickening of the thickness.

2. The sofa-bed according to claim 1, further comprising at least two pairs of said tie rods respectively attached to said fixed frame and said at least one lever of said plurality of levers on opposite sides of said sofa-bed.

3. The sofa-bed according to claim 1, wherein each one of said tie rods has at its ends a hole configured for fixing to a corresponding pin or hook provided on said fixed frame and/or on said at least one lever of said plurality of levers.

4. The sofa-bed according to claim 1, wherein each one of said tie rods has a length of an order of magnitude greater than its height and/or greater than its thickness.

5. The sofa-bed, according to claim 1, wherein each one of said tie rods has a length ranging between 360 and 510 millimeters.

6. The sofa-bed according to claim 1, wherein each one of said tie rods has a height ranging between 60 and 10 millimeters.

7. The sofa-bed according to claim 1, wherein each one of said tie rods has, in its the central portion with respect to said two ends, a transverse thickness ranging between 15 and 5 millimeters.

8. The sofa-bed according to claim 1, wherein each one of said tie rods has, a transverse thickness at said ends ranging between 20 and 10 millimeters.

9. The sofa-bed according to claim 1, wherein said elastomeric material is synthetic or natural.

10. The sofa-bed according to claim 1, wherein said tie rods of said at least a pair of tie rods are adapted to carry out at the same time two opposing actions in order to control the forces into play in the passage from said open configuration to said closed configuration of said sofa-bed, and vice versa.

11. The sofa-bed according to claim 1, wherein said elastomeric material is cis-polyisoprene.

* * * * *